United States Patent [19]

Cary et al.

[11] Patent Number: 4,712,396

[45] Date of Patent: Dec. 15, 1987

[54] EASY TO LOCK DEADBOLT STRUCTURE

[76] Inventors: Arthur P. Cary, 2519 Farrington St., Dallas, Tex. 75207; Leslie W. Lyons, 4215 W. Jefferson St., Dallas, Tex. 75211

[21] Appl. No.: 915,658

[22] Filed: Oct. 6, 1986

[51] Int. Cl.[4] ..... E05B 17/00

[52] U.S. Cl. ..... 70/129; 70/431; 70/441

[58] Field of Search ..... 70/129, 441, 431, 432, 70/DIG. 49, 133, 134

[56] References Cited

U.S. PATENT DOCUMENTS 1,736,761 11/1929 Hoffner ..... 70/282
3,242,708 3/1966 Sanchez ..... 70/282
4,434,635 3/1984 Borgato ..... 70/279
4,557,121 12/1985 Charlton ..... 70/129

*Primary Examiner*—Robert L. Wolfe
*Attorney, Agent, or Firm*—T. D. Copeland

[57] ABSTRACT

This invention provides a means for permitting the deadbolt lock, as used on many residential outside doors, to be quickly and conveniently locked, either from the inside or outside, without requiring the use of a key. This device then requires that the deadbolt lock be opened from the outside by a key in the conventional manner, or from the inside by a conventional finger lever. But to prevent accidental lock out of the resident, this invention further embodies an audible reminder to the user to make sure that the key is in his possession and available for re-entry purposes.

12 Claims, 10 Drawing Figures

EASY TO LOCK DEADBOLT STRUCTURE

BACKGROUND OF THE INVENTION

Deadbolt locks for doors have been in use for a considerable length of time, but they generally require a key to both open and close. Prior art examples of locks not requiring a key are as follows:

U.S. Pat. No. 1,736,761, to Hoffner, discloses a door with a plurality of locks that are opened simultaneously by a push button solenoid arrangement.

U.S. Pat. No. 3,242,708, to Sanchez, discloses a rather complex system of remote control keyless automatic electronic locks, wherein a particular, but changeable combination of pushbutton operations are required to open the door on which this system is installed.

U.S. Pat. No. 4,434,635, to Borgato, discloses a manual and electrically operable automatic hook lock for sliding gate applications.

U.S. Pat. No. 4,557,121, to Charlton, discloses an electrically operated bolt lock that may be spring loaded into either an open or closed position, and may be solenoid operated to the other position.

SUMMARY OF THE INVENTION

In contrast with the prior art disclosed above, it is a primary object of this invention to provide a key opened outside door lock that may be selectively locked from in or outside without the use of a key.

Another object is to provide a door lock that is easily and conveniently prepared for locking from the inside of the door, but one that is actually locked without a key from outside of the door.

And a further object is to provide a manually operated door with the above characteristics, which additionally provides an unmistakeable signal to the user that he must make sure the key is in his possession before he releases the bolt and secures the lock system.

Yet another object of this invention is to provide a conventionally functioning deadbolt lock system in all respects, except that it requires that the user deliberately place the deadbolt in an "armed" or "cocked" retract position, and he then hears an audible signal, which may be sound only, or voice, that warns him that he must take the key with him before he depresses the quick action pin to send the deadbolt "home" and lock the door lock system in a secure manner.

The invention accordingly consists in the features of construction, combination of elements and arrangement of parts which will be exemplified in the construction set forth and the scope of the invention which will be indicated in the appended claims.

Figure 1:
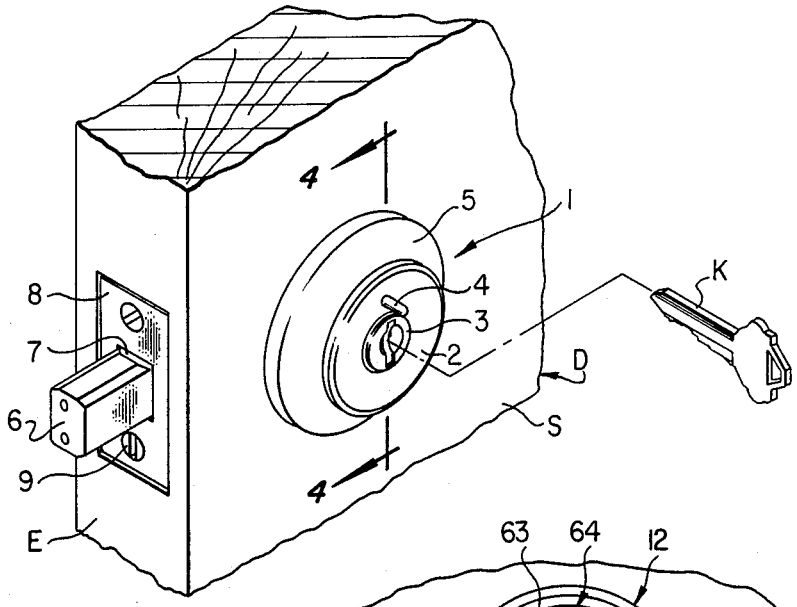
FIG. 1 is a perspective view from the outside, of a portion of a door on which the lock system of this invention is installed.

DESCRIPTION OF PREFERRED EMBODIMENT:

Referring now more particularly to the characters of reference in the drawing, it will be observed in FIG. 1, that a lock assembly designated at 1 is installed in a door D, shown here in fragmentary portion. This lock system 1 shows in FIG. 1, the visible parts of an outer face stationary portion 2, having a rotary key slot member 3, with a closely adjacent push plunger pin 4, and with a bevel ring 5 surrounding the cylinder portion 2 and engaging the outer surface S of door D. At the left of the cylinder portion 2, and shown projecting from the end section E of the door D is the deadbolt 6 projecting thru the opening 7 of a thin recessed face plate 8, which is held in place in the door end E by screws 9. The key K is used only for unlocking the door D.

Figure 2:
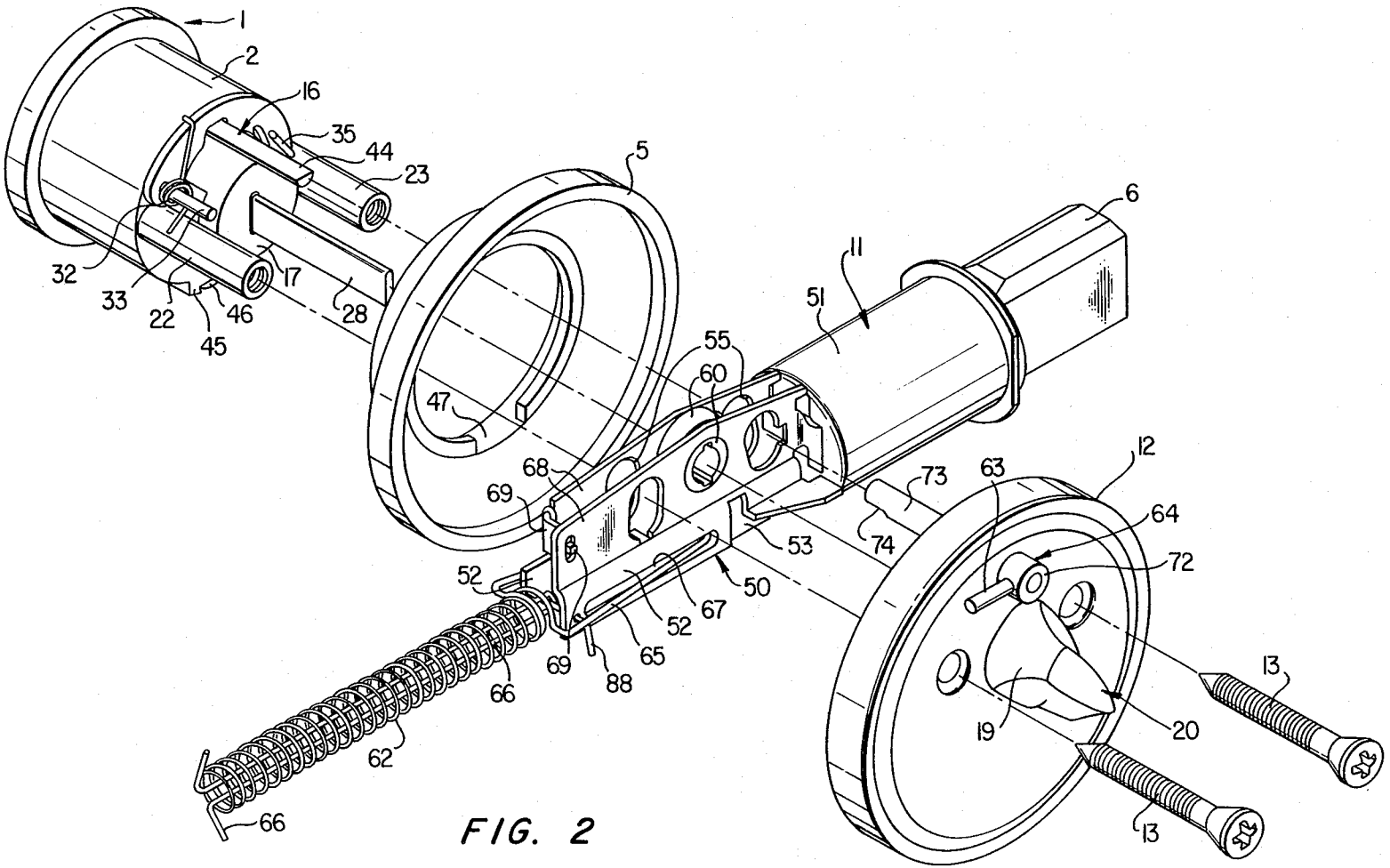
FIG. 2 is an exploded view of the lock system, showing both the internal and the external parts in sequential order.

FIG. 2 shows the major parts of this lock system 1 in exploded convention, starting with the cylinder portion 2 at the upper left of the view, and next in order on the right showing the bevel ring 5, followed by the deadbolt train group 11, and therebeyond, the inner cylindrical mounting plate 12, with its mounting screws 13, detached.

Figure 3:
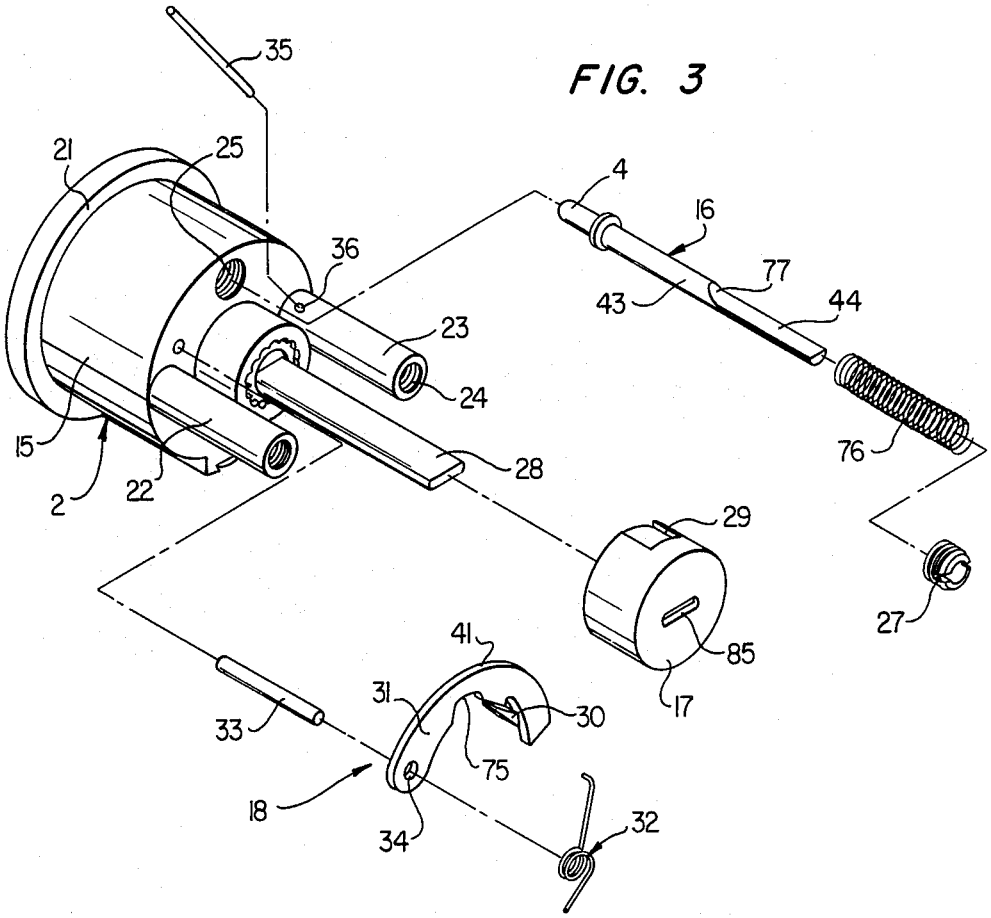
FIG. 3 is a detailed exploded view of the outwardly facing cylinder portion of this lock system.

FIG. 3 shows the cylinder portion 2, itself in exploded convention, starting with the cylinder body 15 at the upper left of this view, and next in order, the three removable groups of the plunger group 16 at the top, the small cylinder shell 17 at the center, and the latch group 18, at the bottom of this view.

Figure 4:
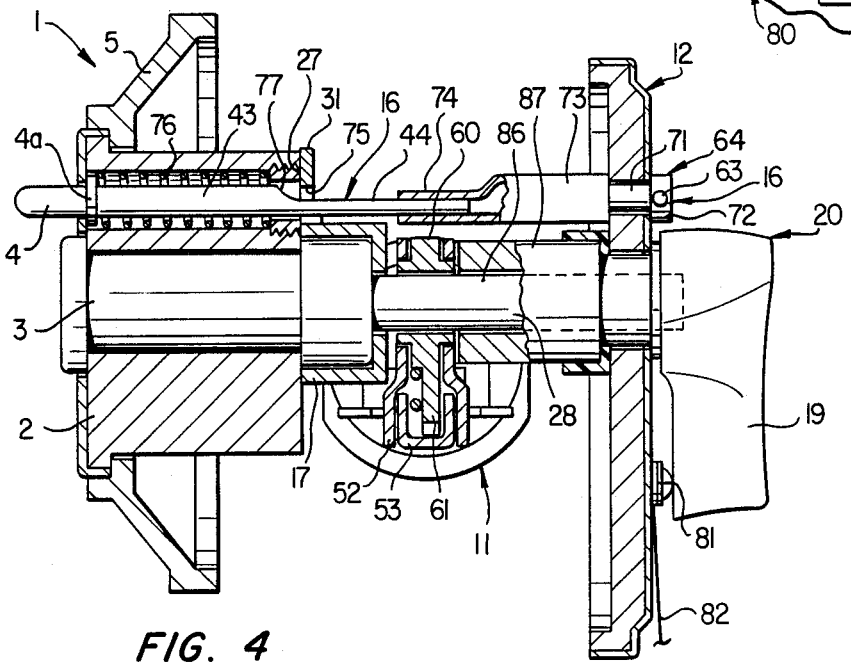
FIG. 4 is a cross section of the assembled lock system, and taken along the lines 4—4 of FIG. 1.

FIG. 4 shows a detailed sectional elevational view of the lock system 1, taken along the lines 4—4 of FIG. 1. The major parts here are the cylinder portion 2, the key slot member 3, push plunger pin 4 of plunger group 16, bevel ring 5, mounting plate 12, plunger train 11, and arming or cocking lever assembly 20, including finger level 19.

Figure 5:
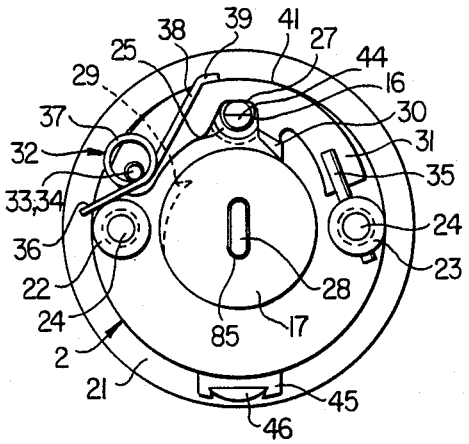
FIG. 5 is an end view of the back of the cylindrical mounting portion of the outwardly facing key containing unit.
Figure 6:
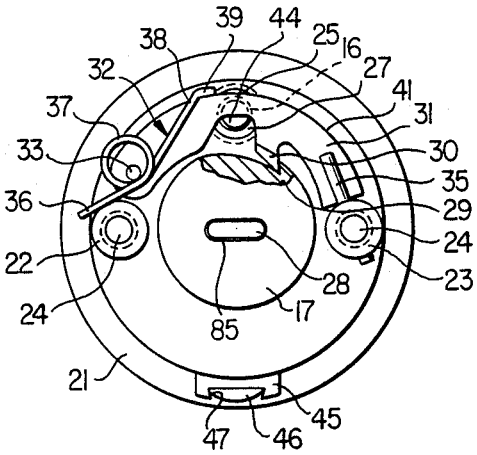
FIG. 6 is a view similar to FIG. 5, but with a cutaway cross section.

FIGS. 5 and 6 are two views of the back side of the main cylinder portion 2, showing the rear of its face plate 21, projecting mounting posts 22 and 23, each having a partially threaded bore 24, a plunger receiving bore 25, having a threaded end into which is inserted the plunger train 16 (of FIG. 3), which is held in place by hollow set screw 27. The small cylinder shell 17 which slips over turn plate 28 includes a circumferential notch 29, seen in FIG. 6 to engage catch 30 of pivot arm 31 of latch group 18 under the urging of spring 32, which is held in place by pin 33, which also projects thru opening 34 to permit pivotal movement of arm 31. Guard pin 35 is wedged into radial opening 36 of post 23 and serves to retain pivot arm 31 in place. Spring 32 includes a downwardly extending end 36, a central coil area 37, and an upwardly extending end 38 that terminates in a tip 39, that bears against top surface 41 of pivot arm 31 to urge arm 31 to pivot downward about pin 33 in such a manner that when catch 30 is properly aligned it will automatically engage notch 29 and prevent any counter-clockwise rotation of shell 17, turn plate 28, or key slot member 3. Plunger rod 43 includes a one-half circular portion 44 that extends rearwardly out thru hollow set screw 27 for a purpose to be hereinafter defined. At the bottom of main cylinder portion 2 is located a guide member 45 with a convex surface piece 46, to orient cooperating slot 47 during assembly. Member 45 and surface piece 46 also enclose the tumblers used during the conventional key opening cycle of lock system 1. Similarly, the mounting posts 22 and 23 align with and pass into the openings 55 and thereupon receive mounting screws at assembly.

Figure 7:
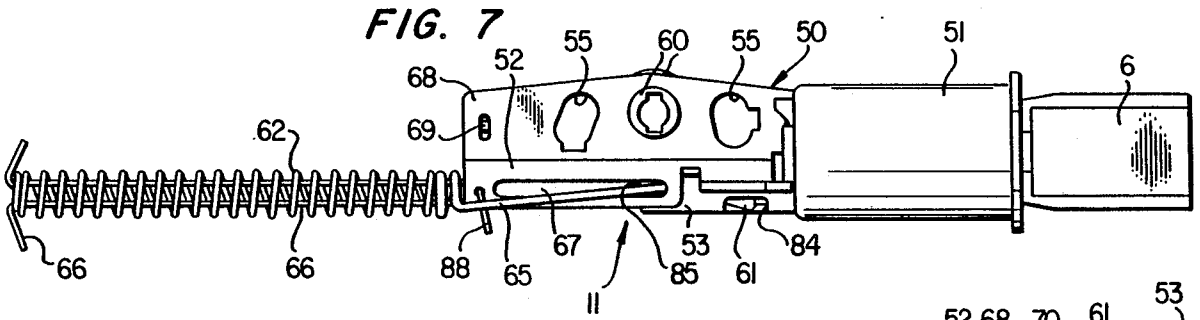
FIG. 7 is a side elevational view of the deadbolt train that spring releases the deadbolt of this lock.
Figure 9:
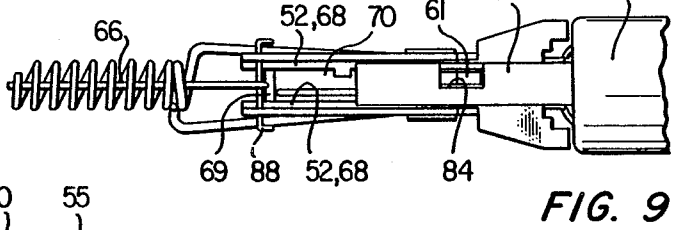
FIG. 9 is a fragmentary plan view of the deadbolt train of FIGS. 7 and 8.
Figure 8:
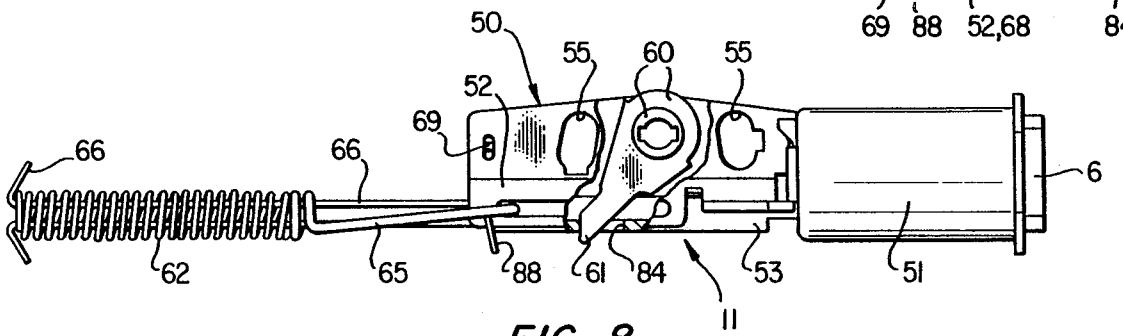
FIG. 8 is a view similar to FIG. 7, but showing the deadbolt in its fully retracted position.

FIGS. 7 and 8 show the deadbolt operating train 11 in its extended and retracted positions respectively. The deadbolt 6 cooperates with a corresponding female slot (not shown) in the door jamb in which door D is installed. The superstructure 50 is attached to the deadbolt guide sleeve 51, and includes a guide trough 52, in which spring carrier guide 53 resides and travels when deadbolt 6 is moving between its locked and unlocked positions. Openings 55 receive mounting posts 22 and 23 on assembly, and the central slotted lever member 60 is part of and permits rotation of the cam lever 61 which moves the deadbolt to its locked and unlocked positions in conventional key and hand lever operations. When the cam lever 61 is moved from its locked to its unlocked position (FIG. 8) the compression spring 62 has been placed under load and the lock system 1 is cocked and may then be released and system 1 locked by the handle 63 of mini-lever unit 64, or by depressing push plunger pin 4. Once locked, the system 1 may then be unlocked only by the key K from the outside, or by the cocking lever 20 from the inside.

When carrier 53 is moved from the deadbolt locked position of FIG. 7 to the unlocked and cocked position of FIG. 8, the spring leads 65 travel with the carrier 53 and compress the spring 62 against its two holding posts 66 that are fixed in the end of superstructure 50. Slots 67 permit the spring leads 65 to travel with carrier 53 to deliver the compression mode to spring 62. Superstructure 50 may be made of two spaced apart side plates 68 with the proper spacers 69 and guide tracks 70.

Figure 1A:
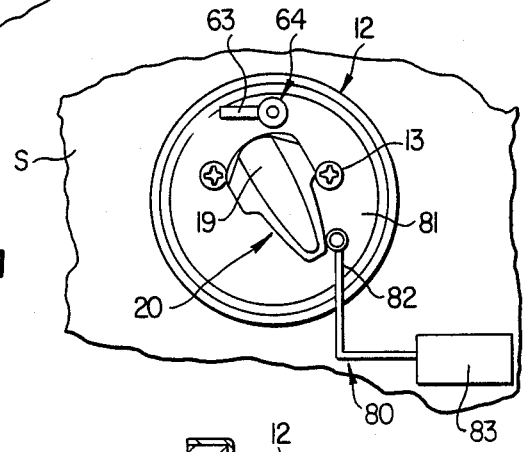
FIG. 1A is an elevational view of the lock system showing both the inside the door controls and the audible warning system.

Referring to the figures, particularly FIGS. 2-4 for an explanation of the operation of this lock system 1, when an occupant plans to leave the building, if the door is locked, he will first rotate the finger lever 19 (FIG. 1A) in the proper direction to both unlock and "arm" or "cock" the deadbolt plunger group 11. After he has passed thru the doorway and out of the building, he will close the door D firmly behind him, and push the push plunger pin 4 to release the mechanism necessary to permit the now spring loaded deadbolt train group 11 to send deadbolt 6 "home" to the socket in the door jamb and securely lock this entrance.

Since this system of locking one's premises is so easy, and does not require a key, there is a risk of the occupant locking himself out without a key and making re-entry extremely difficult and frustrating. To avoid this problem, I have installed a programmed speech unit 80, comprising a push button switch 81 and a flat cable 82 leading to a mini-battery operated speech unit 83 that is programmed to "speak" the words: "Do you have your key?", whenever the finger lever 19 is moved in a direction to cock the deadbolt train group 11, and thus pass over and depress the switch 81.

Once the cocking mechanism has been set and the deadbolt is in its retracted position, the finger lever 19 is no longer capable of locking the system 1 from the inside the building. I have therefore installed a mini-lever unit 64 having a handle 63 that needs only slight rotation to release the deadbolt train group 11 and spring propel the deadbolt 6 to its fully locked position. In FIG. 4, this group 16 is seen to include a shift 71 that is attached to ring 72 on one side of the door D, and attaches to a hollow tube 73 internally of the door. The tube 73 includes a half-circular open end section 74 that engages the half-circular free end portion 44 of plunger rod 43. The engaging flat portions of rod 43 and tube section 74 permit a rotation of handle 63 to be transmitted to rod 43 so that the flat portion 44 will engage the cam slot 75 of pivot arm 31 and lift the catch 30 from its engagement in notch 29 and thus permit the compressed spring 62 to send the deadbolt 6 to its fully locked position. The locking action obtained from outside the door is similar in that depressing push pin 4 and its collar 4*a* will compress plunger spring 76 against set screw 27 and simultaneously move plunger rod 43 and its cam surface 77 to a point where it engages cam slot 75 and lifts the pivot arm 31 to disengage catch 30 from notch 29 and permit the described spring locking of deadbolt 6.

Both the externally accessible key slot member 3 and the internally accessible lever group 20 have a common connection internal of the door D, so that either may be used to lock and unlock the door. This connection includes the rotary key slot member 3 and its projecting turnplate 28 that passes thru corresponding slot 85 in shell 17 and slot 86 in lever cylinder 87, which slot passes even into lever 19. This turnplate 28 also passes thru the slotted lever member 60 of the deadbolt train group 11. Rotating the turnplate 28 thus turns the slotted lever member 60 in a direction to lock or unlock (and cock the deadbolt train group 11 under the action of leyer 61 bearing against the movable portion of carrier 53.

Figure 10:
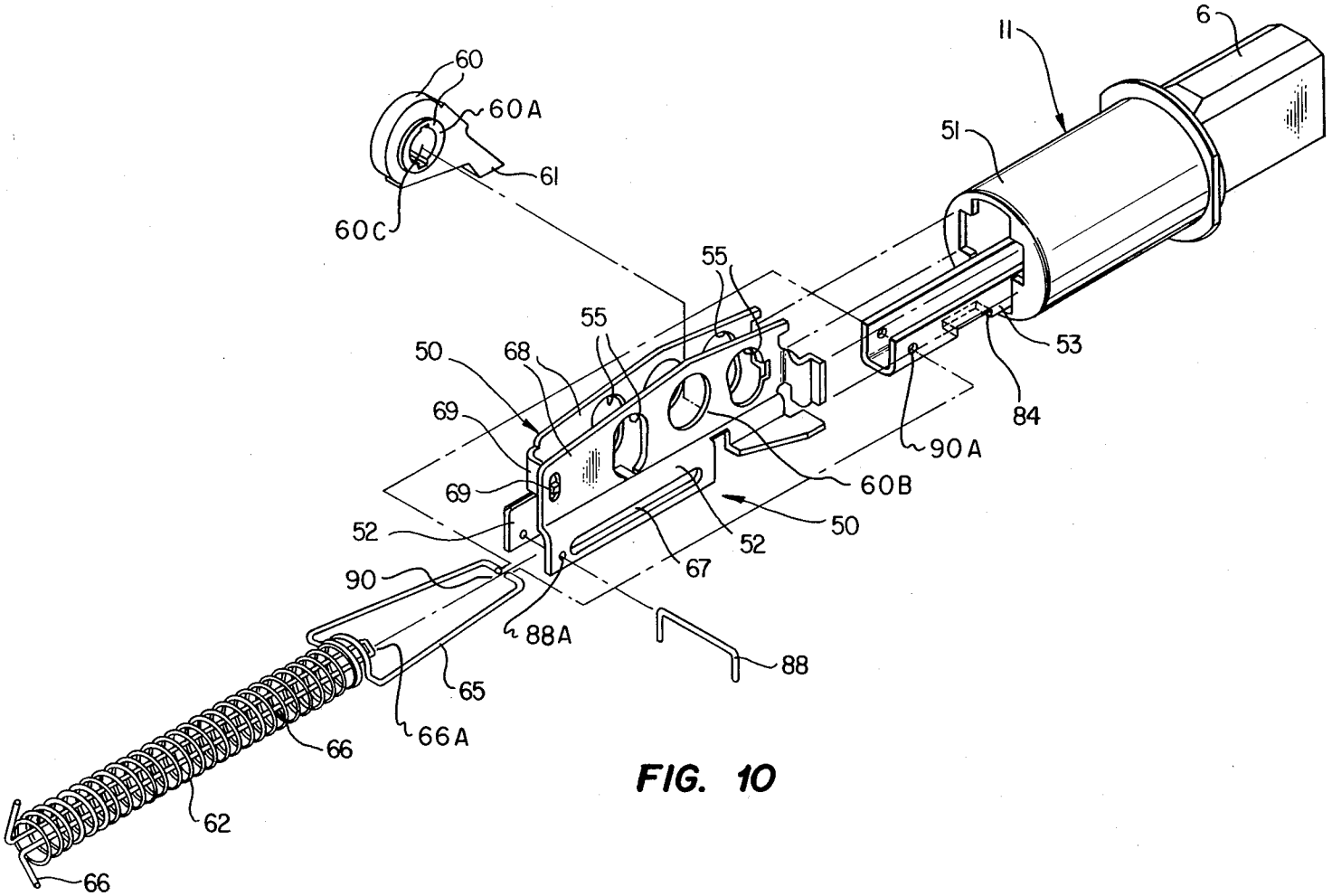
FIG. 10 is an exploded isometric view of the deadbolt train subassembly shown in FIGS. 2, and 7–9.

FIG. 10 should be examined in connection with the other figures of the drawing, and particularly with FIGS. 2, and 7-9, since it is an exploded view of the deadbolt train subassembly 11 of FIG. 2, which is comprised largely of conventional lock system parts, such as the deadbolt 6, sleeve assembly 51 containing means for guiding carrier 53 that also slides within the track 52 defined by sideplates 68 of the structure 50. The aligned openings 55 in sideplates 68 permit mounting posts 22 and 23 (FIG. 3) to project therethru and receive mounting screws 13 at assembly.

The sideplate aligned openings 60B in the FIG. 10, receive the raised circular bosses 60A of lever 60 on assembly (FIGS. 7 & 8). Lever 60 and projecting bosses 60A include an internal bore having a slot 60C into which turnplate 28 (FIG. 3) projects on assembly. Turnplate 28 is rotated selectively by the key slot mechanism 3 or by lever 19 when either 3 or 19 are in the lock opening or cocking mode, and since turnplate 28 engages slot 60C when assembled, its rotation causes tip 61 of lever 60 to move in a direction to cause carrier 53 and deadbolt 6 to move to the unlocked and cocked position.

In thus moving from the locked position of FIG. 10 and FIG. 7, to the unlocked and cocked position of FIG. 8, the spring leads 65 compress the spring 62 against the spring holder 66, so that when plunger 4 is depressed or minilever 63/64 is rotated to lift arm 31 and latch 30 out of catch 29, the full force of compressed coil spring 62 is sufficient to send the deadbolt 6 "home", and securely lock the door D.

As for the construction details, the single loop 66A at the inner end of spring holder 66 passes over and around locking pin 88, which is held in place by passing thru aligned openings 88A in sideplates 68 (one free end of pin 88 is bent after assembly). The free ends 90 of spring lead 65 pass thru slots 67 on assembly to engage in aligned openings 90A of carrier 53, so that spring 62 is compressed when lever tip 61 bears against one edge of carrier slot 84 in response to the unlocking action of key slot mechanism 3, or to the unlocking and cocking motion applied to lever 19. Then, when the power locking mode is initiated by depressing pin 4 or rotating mini-lever 63/64, lever tip 61 moves freely as the spring 62 expands and propels carrier 53 and deadbolt 6 to their locking position.

The force required to cock the spring 62, when unlocking the lock system 1 with key 4 and when cocking the spring 62 via inside lever 19, is of the same order of magnitude as the force released by spring 62 when expanding to send deadbolt 6 "home"; which force is relatively small, since there are no obstructions in the travel paths of carrier 53 in track 52, or within the guide sleeve 51 of a conventional lock system.

As will be apparent to persons skilled in the art, various modifications and adaptations of the structures above described will become readily apparent without departure from the spirit and scope of this invention, which is defined in the appended claims.

I claim:

1. In a lock system including a deadbolt and key and lever means to unlock said system, the improvements comprising:

a. means operable in response to movement of said lever means to hold said deadbolt in an unlocked position, and b. release means operable apart from said key and lever means to cause said deadbolt to move to a locked position.

2. A locked system as in claim 1 further characterized by a speech system operable by said movement of said lever means.

3. A lock system as in claim 1, wherein said release means comprises a push button on at least one outer side of said lock system.

4. A lock system as in claim 1, wherein said release means comprises a mini-lever on at least one outer side of said lock system.

5. A lock system as in claim 1 wherein said deadbolt is placed in a cocked position by a spring that is placed under load by said key and lever means.

6. A lock system as in claim 1, wherein said release means is operable from either side of said lock system when said lock system is installed in a door.

7. In a lock system including a deadbolt in a deadbolt train means and an interconnected key means and lever means, each operable independently to move said deadbolt train means, the improvements comprising:

a. notch and catch means operable in response to movement of either said key means or said lever means to hold said deadbolt in an unlocked position, and b. cam means operable independently of said key means or lever means to cause said deadbolt means to propel said deadbolt home.

8. A lock system as in claim 7, wherein said lock system is installed in a door leading to the outside of a building, and wherein said cam means is operable from either side of said door.

9. A lock system as in claim 7, wherein said cam means is finger operated.

10. A lock system as in claim 7, wherein said lever means will place said deadbolt in a cocked position and ready for instantaneous movement to a fully locked position.

11. A lock system as in claim 8 that includes an audible system on the inside of said door.

12. A lock system as in claim 11 wherein movement of said lever means activates said audible system to warn the user to have his key available for re-entry after the locking action is completed.

* * * * *